United States Patent [19]

Huddon

[11] 4,292,715

[45] Oct. 6, 1981

[54] JEWELRY CLUTCH

[76] Inventor: Lawrence T. Huddon, 22 Overhill Rd., Warwick, R.I.

[21] Appl. No.: 57,757

[22] Filed: Jul. 16, 1979

Related U.S. Application Data

[63] Continuation-in-part of Ser. No. 916,552, Jun. 19, 1978, abandoned.

[51] Int. Cl.[3] ..... A44B 9/10

[52] U.S. Cl. ..... 24/155 C; 63/13; 411/438

[58] Field of Search ..... 24/155 RB, 155 C, 155 SD, 24/64, 90 E, 85 R, 403/229, 372; 85/36 R; 151/14 CS; 63/12, 13

[56] References Cited

U.S. PATENT DOCUMENTS

| | | | |
|---|---|---|---|
| 439,457 | 10/1890 | Whittemore et al. | 24/155 C |
| 867,943 | 10/1907 | Boles | 24/155 C |
| 995,744 | 6/1911 | Watkins | 24/155 C |
| 1,024,865 | 4/1912 | Reynolds | 24/155 C |
| 1,054,319 | 2/1913 | Shaw | 24/155 C |

FOREIGN PATENT DOCUMENTS

| | | | |
|---|---|---|---|
| 70506 | 7/1915 | Austria | 24/155 C |
| 837328 | 3/1952 | Fed. Rep. of Germany | 63/12 |
| 407716 | 3/1910 | France | 24/155 C |
| 14725 | of 1903 | United Kingdom | 24/155 C |

*Primary Examiner*—Alexander Grosz
*Attorney, Agent, or Firm*—Barlow & Barlow

[57] ABSTRACT

A clutch device for holding together two articles of jewelry such as earrings, pins, necklaces, etc. The clutch comprises a tubular housing closed at both ends except for a small central opening in the center of each end. A coil spring is mounted in the housing. Each end of the spring is turned inwardly toward the axis of the spring so that a sharp edge at the end presents itself to a pin entering the openings. The sharp edge grips the pin and holds it against removal. In an alternative construction, only one end of the housing is provided with the pin entry, and only one end of the spring is turned inwardly to grip the pin. In both cases, the pressure of the inturned sharp edge is enhanced by the action of the spring coils. The second part of the clutch is thus a pin having a diameter slightly less than the internal diameter of the spring. The pin may be attached to a piece of jewelry such as an earring, etc. The pin can also be provided with one or more transverse grooves adapted to receive the sharp inturned end of the spring for a more positive grip and lock. The tube and spring can be made extremely small and can be sunk into a part of various jewelry items. With the tube in one part and a pin in the other, two jewelry portions can be joined by a frictional gripping action.

8 Claims, 14 Drawing Figures

JEWELRY CLUTCH

The present invention comprises a continuation-in-part of my copending application entitled JEWELRY CLUTCH, Ser. No. 916,552, filed June 19, 1978 now abandoned.

BACKGROUND OF THE INVENTION

Safety clutches have long been provided for covering the sharp pointed ends of jewelry pins, tie pins, etc. These devices all provide for a housing having a coil spring. When the device is pushed over the pointed end of a pin, the coil spring frictionally engages the pin to hold the device in place. The device is not generally used to hold jewelry together because the friction grip of the spring provides a yielding action which is just sufficient to hold the device on the pin. Examples of some of the devices are shown in the following U.S. Pat. Nos. 239,801, 439,457, 599,353, 862,920, 982,829, 986,053, 1,024,865.

SUMMARY OF THE INVENTION

The present invention provides a clutch device which resembles the conventional safety clutch shown in the cited patents, but which uses an entirely different gripping action resulting in a much firmer grip and allowing the components to be incorporated in an article of jewelry. The device comprises a small tubular housing closed at the front end except for a small central opening. A coil spring is mounted in the housing and the rear end is swaged after assembly to hold the spring in place. The front end of the spring is turned in toward the axis of the spring to form a restricted passageway through the spring. The end of the spring wire is turned in at an angle so that the sharp edge at the end presents itself to a pin entering the front opening into the spring. The sharp edge engages the pin to frictionally grip it against removal. In an alternate construction, both ends of the housing are identical and both ends of the spring are turned in to present a sharp edge to the pin. This provides a double gripping action. In either construction, the pressure of the spring end is enhanced by the tension of the spring coils. The second part of the device is a pin having a diameter which is just small enough to slide through the housing openings and the spring. The pin may be attached to a piece of jewelry such as an earring, pin, etc. The tube may be very small and can be mounted in part of various jewelry items. With the tube in one part and a pin in the other, the clutch will releasably hold the parts together with a firm grip. If desired, the pin may be provided with one or more spaced transverse grooves into which the ends of the coil spring will enter to provide a safety lock or grip.

DESCRIPTION OF THE INVENTION

Figure 1:
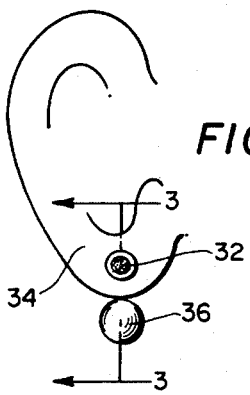
FIG. 1 is a front view of an earring embodying my present invention mounted on an ear lobe.
Figure 2:
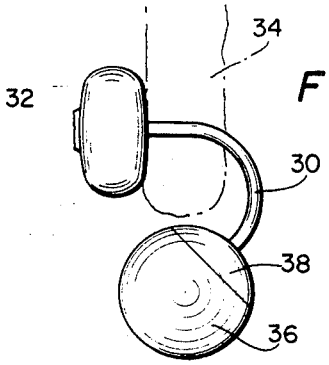
FIG. 2 is an enlarged side elevation of the earring as shown in FIG. 1.
Figure 4:
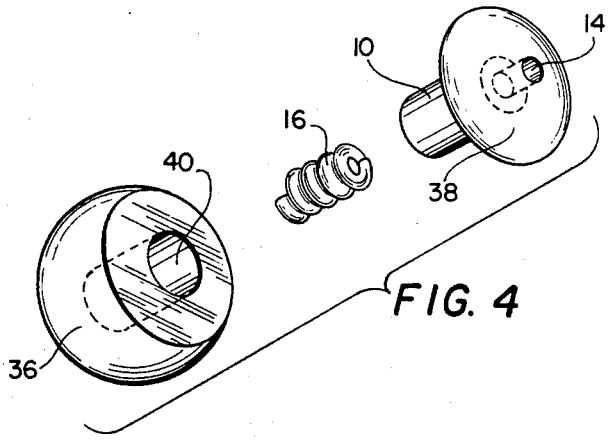
FIG. 4 is an enlarged exploded perspective view of the clutch mechanism.
Figure 3:
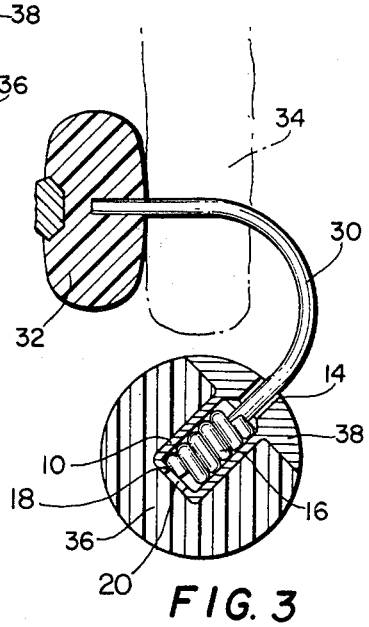
FIG. 3 is an enlarged section taken on line 3—3 on FIG. 1.

Referring more in detail to the drawings, FIGS. 1 to 5, inclusive, illustrate the invention applied to one type of pierced earring. The device comprises a hollow tubular housing 10, FIGS. 3 and 4, closed at the front end by the spherical segment 38 having an axial opening 14 communicating with the interior of the housing 10. The tubular housing 10 may be a separate unit attached to the segment 38 as shown in FIG. 4. The rear of the housing 10 is initially open. A coil spring 16 is slipped into the housing, the spring 16 having an outer diameter slightly smaller than the inner diameter of the housing. The rear of the housing 10 is now swaged over at 18 to lock the spring in place.

Figure 5:
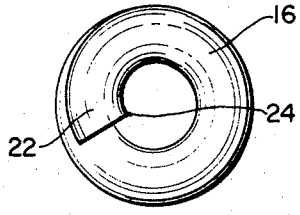
FIG. 5 is a plan view of the front end of the coil spring showing the gripping end of the spring.

The front opening 14 has a diameter approximately equal to the inner diameter of the spring 16. Note also that an opening 20 is left at the rear end. Referring to FIG. 5, the front end of the spring 16 is turned inwardly at 22 to present a sharp edge 24 adjacent the axis of the spring. With this construction, when a pin is inserted through the front opening 14 into the coil spring 16, the pointed edge 24 of the spring at the end will dig into and engage the pin with a firm grip. The coil spring adds pressure to the pointed edge to ensure the firm grip on the pin. The gripping action is at the front end of the spring with the coil supplying the pressure. The grip is firm and much greater than that obtained with a conventional gripping coil as shown in the art.

The above construction lends itself to infinite variations in jewelry design. For example, FIGS. 1 to 4 illustrate an earring having a central pin which passes through the ear lobe and an ornamental portion at each end. The pin is bent so that both ornaments will extend forwardly and be visible from the front. In detail, the pin 30 has one end mounted in an ornamental member 32. The pin 30 passes through the ear lobe 34 and a second ornamental member, such as the pearl bead 36, is mounted thereon. As can be seen, the bead 36 has been cut off to form a segment 38 which may be of the same material, or may be constructed of a contrasting metal. The bead has a central opening 40. The clutch device, tube 10 and spring 16 as hereinabove described, is mounted in the opening 40, FIG. 3, either by molding, glueing, or friction. Now the pin 30 is inserted into the opening 14 and into the spring 16 so that the gripping action will hold the ornament 36 on the pin.

Figure 6:
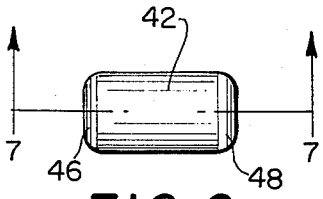
FIG. 6 is a side elevation of a small uniform housing of the present invention.
Figure 7:
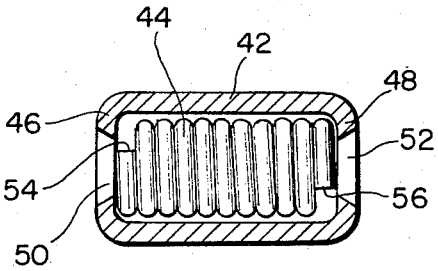
FIG. 7 is an enlarged section taken on line 7—7 on FIG. 6.
Figure 8:
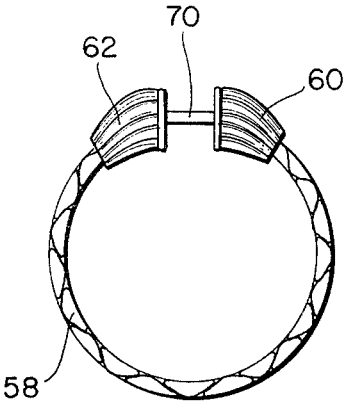
FIG. 8 is a side elevation of an earring embodying my present invention.
Figure 9:
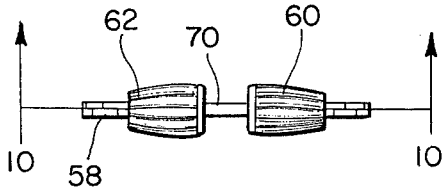
FIG. 9 is a top plan view of the earring shown in FIG. 8.

FIGS. 6 and 7 illustrate the device in a more practical manufacturing form. Here the barrel shaped housing 42 contains a coil spring 44. The spring is held in the housing by the inturned ends 46 and 48 which are identical. The openings 50 and 52 at each end communicating with the center of the spring 44 are also identical. Furthermore, both ends of the spring, 54 and 56, are turned in as in FIG. 5 to provide identical gripping actions at both ends.

With the above construction, the manufacture of the clutch is greatly simplified and is less costly. In mounting the device in an item of jewelry it will not matter which end is inserted first. And, of course, the gripping action has been doubled, now working on both ends of the spring.

With the construction shown in FIGS. 6 and 7, the pin can be made to provide a locking action which can be varied with different jewelry constructions. For example, FIGS. 8, 9, 10 and 11 illustrate the device as a clutch for a piercing earring. The ornamental earring loop 58 is provided at one end with the block 60 and at the opposite end with a block 62, both blocks having apposed faces 64 and 66.

The block 60 has a central horizontal opening 68 in which the barrel housing 42 with the spring 44 is mounted. The housing 42 may be molded into, frictionally forced into, or glued into the opening 68. Note that the opening 68 is longer than the housing 42 so that space is left for the tapered end of the clutch pin being inserted.

Figure 10:
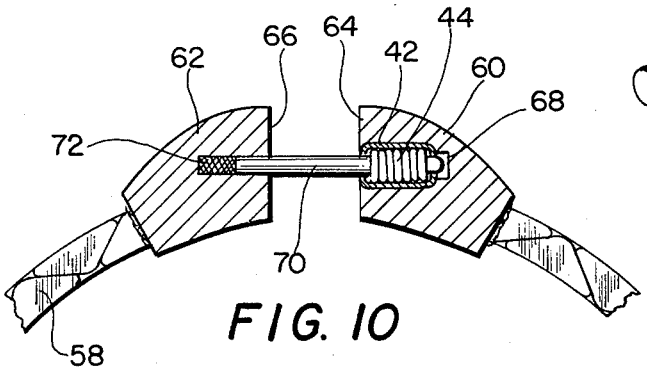
FIG. 10 is an enlarged section taken on line 10—10 on FIG. 9.
Figure 11:
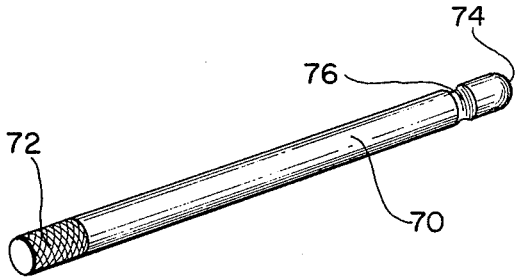
FIG. 11 is an enlarged perspective view of the grooved pin for the earring clutch of the present invention.

Now referring to FIGS. 10 and 11, I provide an elongated clutch pin 70 adapted to pass through a pierced ear lobe and having a diameter slightly less than the inside diameter of the spring 44. One end of the pin 70 may have a knurling 72 for greater holding power when it is mounted in the block 62, FIG. 10. It is preferable that the free end of the pin 70 be rounded at 74. Now, when the pin 70 is passed through an ear lobe, it can be pushed into the spring 44 until the end 74 passes through the housing 42, FIG. 10. In this position, the earring is fastened to the ear lobe and there is sufficient distance between the blocks 60 and 62 to comfortably accommodate the ear lobe.

As can be seen in FIG. 10, the pin 70 extends through the spring 44 so that both ends of the spring exert a gripping action on the pin 70. To further enhance this grip and provide a safety lock, the pin 70 is provided with a transverse groove 76 spaced from the end 74. Now, when the woman pushes the pin 70 into the spring 44, she can continue to push until the inner spring gripping point 56 snaps into the groove 76. The user will feel and hear the snap action. The parts will separate on being pulled, but are safely engaged against accidental separation and loss of the earring.

Figure 12:
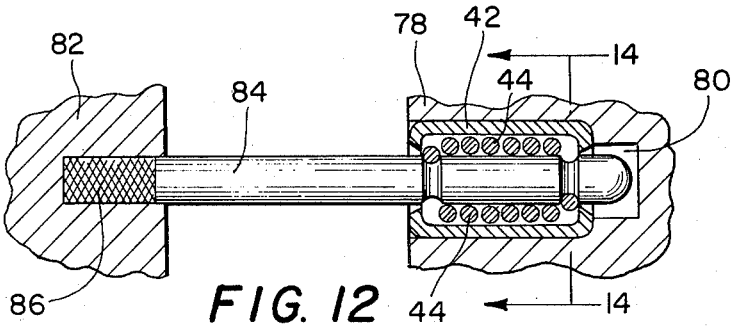
FIG. 12 is an enlarged section of a necklace clasp having a clutch of the present invention.
Figure 14:
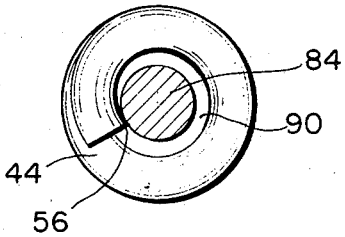
FIG. 14 is a section taken on line 14—14 on FIG. 12.
Figure 13:
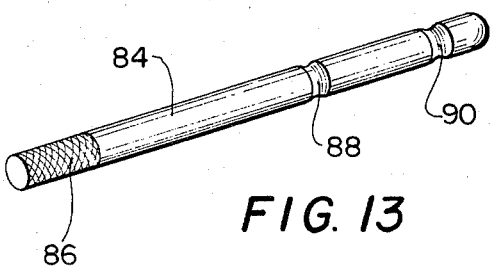
FIG. 13 is an enlarged perspective view of the pin for the necklace clasp shown in FIG. 12.

The construction shown in FIGS. 12, 13 and 14 illustrate the clutch with a double safety lock for use with heavier pieces of jewelry such as bracelets and necklaces. In this form, one end of the jewelry clasp 78 is provided with the opening 80 in which the housing 42 and spring 44 are mounted. The other part of the clasp 82 is provided with the pin 84 shown in FIG. 13. This pin 84 is also provided with a knurled end 86 for mounting in the clasp 80. Spaced from the opposite end, the pin 84 is provided with two spaced transverse grooves 88 and 90. The spacing is equal to the length of the spring 44. Thus, when the pin 84 is pushed into the spring 44, both ends of the spring, 54 and 56 will snap into the grooves 88 and 90. This provides a double locking action. In the form shown in FIG. 12, the pin 84 may be shortened to bring the clasp parts 78 and 82 in close proximity.

Applicant has found that even a very small tubular housing, perhaps 1/16" long, and a like spring mounted therein, will provide a sufficient gripping power to hold a small pin and its attached jewelry. Thus an infinite variety of uses can be found for the device. It is merely necessary to imbed the small tube and enclosed spring in one member and supply the second member with a suitable pin. It should be noted that when the parts are locked together, rotation of the pin will cause the the spring to also rotate in the barrel housing. Therefore, twisting the pin will not affect the grip. Only a direct pull will separate the parts.

The device is simple and easy to manufacture and assemble. The clutch device and associated pin can be made and sold to jewelry manufacturers for assembly in all types of costume jewelry. Other advantages of the present invention will be readily apparent to a person skilled in the art.

I claim:

1. A jewelry clutch comprising a small hollow tubular housing having integral front and rear walls, a coil spring mounted in said housing having an outer diameter slightly smaller than the inner diameter of said housing, said front and rear walls having central openings communicating with the inside of said coil spring, and a pin adapted to fit into said openings and into said coil spring, the outer diameter of said pin being smaller than the inside diameter of said coil spring, said coil spring having means at each end for frictionally engaging said pin when said pin is pushed into said housing.

2. A jewelry clutch as in claim 1, wherein said means comprises the inturned ends of said coil spring presenting a sharp edge to said pin to restrict the passage of said pin into said coil spring.

3. A jewelry clutch as in claim 2, wherein said pin is provided with a transverse groove spaced from the front end, said groove engaging one end of said coil spring when said pin is completely inserted in said housing to releasably retain said pin in said housing.

4. A jewelry clutch as in claim 2, wherein said pin is provided with a pair of spaced transverse grooves, each of said grooves engaging one end of said coil spring when said pin is inserted in said housing to releasably retain said pin in said housing.

5. A jewelry clutch as in claim 2, wherein said housing is axially embedded in an article of costume jewelry and said pin is mounted in a complementary piece of costume jewelry.

6. A jewelry clutch as in claim 1, wherein said pin is provided with a transverse groove spaced from the front end, said groove engaging one end of said coil spring when said pin is completely inserted in said housing to releasably retain said pin in said housing.

7. A jewelry clutch as in claim 1, wherein said pin is provided with a pair of spaced transverse grooves, each of said grooves engaging one end of said coil spring when said pin is inserted in said housing to releasably retain said pin in said housing.

8. A jewelry clutch as in claim 1, wherein said housing is axially embedded in an article of costume jewelry and said pin is mounted in a complementary piece of costume jewelry.

* * * * *